US005685487A

United States Patent [19]

Ellis

[11] Patent Number: 5,685,487

[45] Date of Patent: Nov. 11, 1997

[54] COMPACT HIGH PRESSURE FORWARD JETTING SPINNING NOZZLE FOR CLEANING

[75] Inventor: Fife B. Ellis, Houston, Tex.

[73] Assignee: J. Edward Stachowiak, Houston, Tex.

[21] Appl. No.: 516,207

[22] Filed: Aug. 17, 1995

[51] Int. Cl.[6] ..... B05B 3/06

[52] U.S. Cl. ..... 239/261; 239/DIG. 13

[58] Field of Search ..... 239/225.1, 237, 239/251, 252, 255, 259, DIG. 13, 261; 134/167 C, 168 C

[56] References Cited

U.S. PATENT DOCUMENTS 4,164,325 8/1979 Watson ..... 239/261 X 4,715,538 12/1987 Lingnau ..... 239/251 X 5,060,863 10/1991 Hammelmann ..... 239/259 X 5,104,043 4/1992 Pacht ..... 239/252 X

*Primary Examiner*—Andres Kashnikow

*Assistant Examiner*—Steven J. Ganey

*Attorney, Agent, or Firm*—Bush, Riddle & Jackson

[57] ABSTRACT

A high pressure spinning nozzle for cleaning material from a surface such as the inner walls of a heat exchanger tube, for example, includes a tubular body having an open front end and a plug in its rear end, a rotor in the body bore having an internal flow passage and inclined and skewed orifices in its front wall that cause the rotor to spin during operation, axial and radial passages in the body to feed high pressure water to the rotor flow passage, a water bearing between the rear of the rotor and the plug, and ports in the body to automatically regulate the pressure of the water bearing.

18 Claims, 2 Drawing Sheets

FIG.3
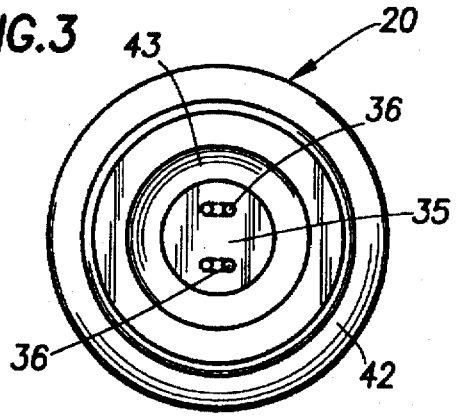
FIG.4
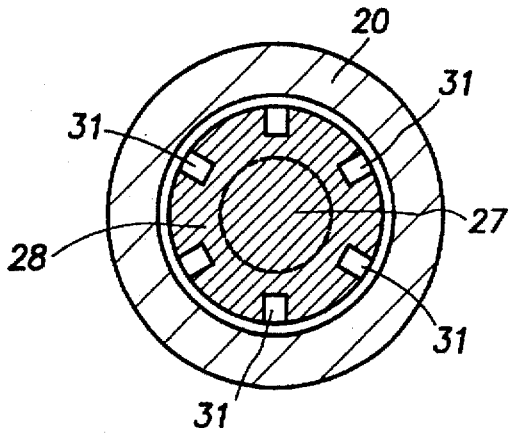
FIG.5
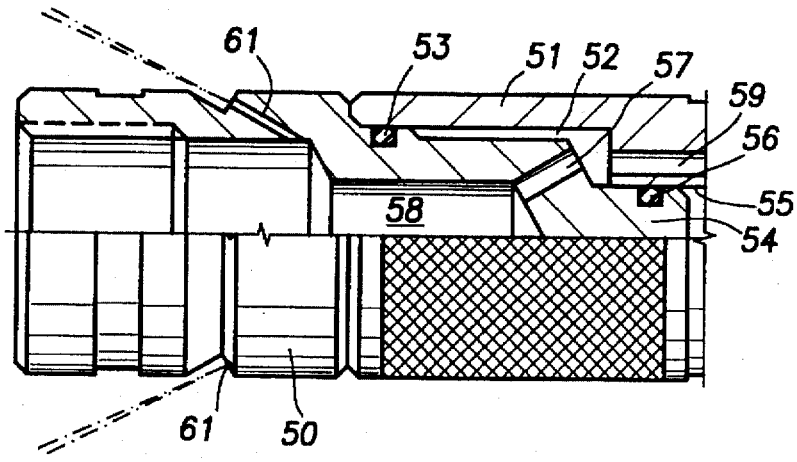
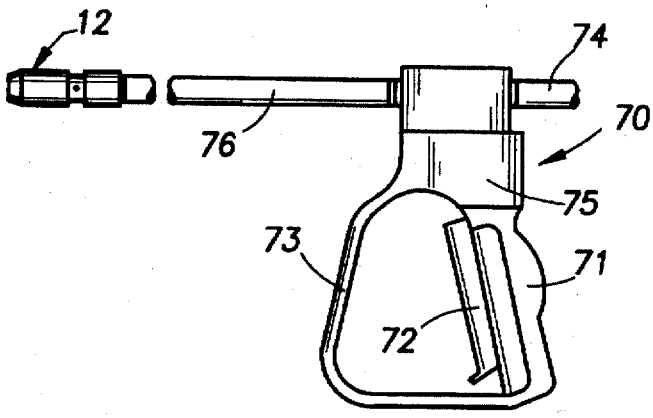
FIG.6

COMPACT HIGH PRESSURE FORWARD JETTING SPINNING NOZZLE FOR CLEANING

FIELD OF THE INVENTION

This invention relates generally to a high pressure nozzle that is used to clean interior or exterior surfaces in limited spaces such as cleaning out partially or totally plugged tubes in the core of a heat exchanger or the like, and particularly to a rotary nozzle assembly for such use that is constructed and arranged to continue to spin and clean even though the assembly is pushed up against a tube blockage or other surface being cleaned.

BACKGROUND OF THE INVENTION

Various waterblast techniques have been used to clean out tubes that have become plugged or blocked by deposits, for example the heat transfer tubes used in an exchanger. One technique involves the use of a fixed, stationary nozzle on the end of a high pressure wand or lance that is inserted into the tube so that sprays from the tip cut away the blockage. This technique has the disadvantage that the water being discharged from the nozzle cuts only at one point or plane, and does not quickly and efficiently remove the blockage. Another technique employs a high pressure swivel that allows the nozzle to rotate or spin inside the tube, so that high pressure water being discharged has a circular or conical cutting pattern that is larger than in a fixed system. The full blockage can be removed quicker and easier because of the increased cutting area. Although this technique is more efficient, the high pressure swivel and its driver add considerably to the cost of the system and make it much more complex. Moreover, such swivels have bearings and high pressure seals that wear and must be periodically replaced, and which add bulk and weight that makes handling the lance and nozzle more cumbersome.

Yet another nozzle system that has been used for this purpose is of the type disclosed in U.S. Pat. No. 4,715,538. This system employs a self-contained spinning nozzle which is mounted on an extension of the body which is threaded onto the outer end of the lance. The nozzle has multiple orifices which are arranged to cause it to automatically spin and provide greater cleaning area or coverage. The need for a high pressure, expensive swivel also is avoided. However this device has a number of drawbacks. For one thing the external spinning rotor will stop if it is pushed against a blockage, and there is no way for the operator to know if there is clearance, or where the blockage is with respect to the front of the nozzle. Stoppage increases tube cleaning time, and the possibility of damage to the face of the rotor.

The spinning-type nozzle also has other applications such as cleaning exterior surfaces such as the walls in a tank or vessel. A rotating nozzle has the benefit of increased cleaning area coverage compared to a conventional straight or "fan" type nozzle. By covering more area cleaning times can be reduced to save on overall cleaning costs. Examples of these rotating surface nozzles are shown in U.S. Pat. No. 4,821,961 and advertising materials of the Hammelmann Corp. dated Oct. 26, 1987 for its so-called "Rotorjet" nozzle. These devices are somewhat similar in construction in that they have external spinning rotors or elements. Because of the external spinning rotor a guard or shield covering the outside of the rotor is used to prevent damage to the nozzle assembly by contact with a stationary object. Moreover these nozzle assemblies tend to be large and heavy which make the operation of such nozzles awkward and cumbersome which creates operator fatigue when placed on a wand or spray gun. Additionally these nozzle assemblies tend to have several precision machined components which makes overall and replacement cost high.

An object of the present invention is to provide a new and improved forward cleaning spinning nozzle assembly for high pressure water blast cleaning of tubes that obviates the problems noted above.

Another object of the present invention is to provide a new and improved rotating-type surface cleaning nozzle assembly of the type described that is constructed and arranged to have an internal spinning rotor which is protected from damage by contact with surface or stationary objects.

Another object of the present invention is to provide a new and improved spinning nozzle that is relatively simple in construction, small and lightweight, and has fewer components and is more economical to operate.

Still another object of the present invention is to provide a new and improved nozzle assembly of the type described where a liquid bearing is used for free rotation of the spinning rotor.

SUMMARY OF THE INVENTION

These and other objects are attained in accordance with the present invention through the provision of a nozzle assembly including a tubular body having a threaded end to connect the body to a source of high pressure water. The body is formed with an elongated bore that receives a cylindrical rotor having a front wall and a rear wall and several radial flow passages near its center which communicate with longitudinal flow passages that extend rearward in the body outside the bore. The front wail of the rotor has a plurality of skewed orifices formed therethrough so that high pressure water flow therethrough generates reaction torque which causes the rotor to spin in operation. Such front wall is located rearward of the front end of the body so that engagement with blocking material or a surface being cleaned does not stop the rotation and operation of the rotor.

High pressure water also flows rearward through the annular clearance between the rotor and the body bore and into the region between the rear wail of the rotor and a plug in such bore. The pressure forces on the rear wall urge the rotor forward so that it spins against a water bearing in operation. Radial ports in the body communicate the exterior thereof with its bore at a location which provides automatic pressure regulation by bleeding off pressure when the rear end of the rotor uncovers such ports. The rear wail of the rotor is formed by a mechanical bearing member such as a ball which provides point contact with the plug when engaged therewith. The rear portion of the body can be provided with several outwardly rearwardly and inclined thruster nozzles to provide a net axial thrust in the forward direction for tube cleaning applications.

Since the rotor is enclosed within the body, spinning thereof is not affected by engagement of the body with blocking material in a tube being cleaned or by contact with a stationary object. However the advantages of a spinning rotor cutting action are obtained in an assembly that is not bulky or heavy, and which operates efficiently and quickly to remove blockages in a tube.

BRIEF DESCRIPTION OF THE DRAWINGS

The present invention has the above as well as other objects, feature and advantages which will become more clearly apparent in connection with the following detailed description of preferred embodiments, taken in conjunction with the appended drawings in which:

FIGS. 3 and 4 are cross-sections of lines 3—3 and 4—4 of FIG. 2;

FIG. 5 is a view similar to FIG. 2 of a modified form of the present invention; and FIG. 6 is another schematic view showing the nozzle assembly attached to the end of a waterblast gun and used for surface cleaning.

DETAILED DESCRIPTION OF THE PREFERRED EMBODIMENTS

Figure 1:
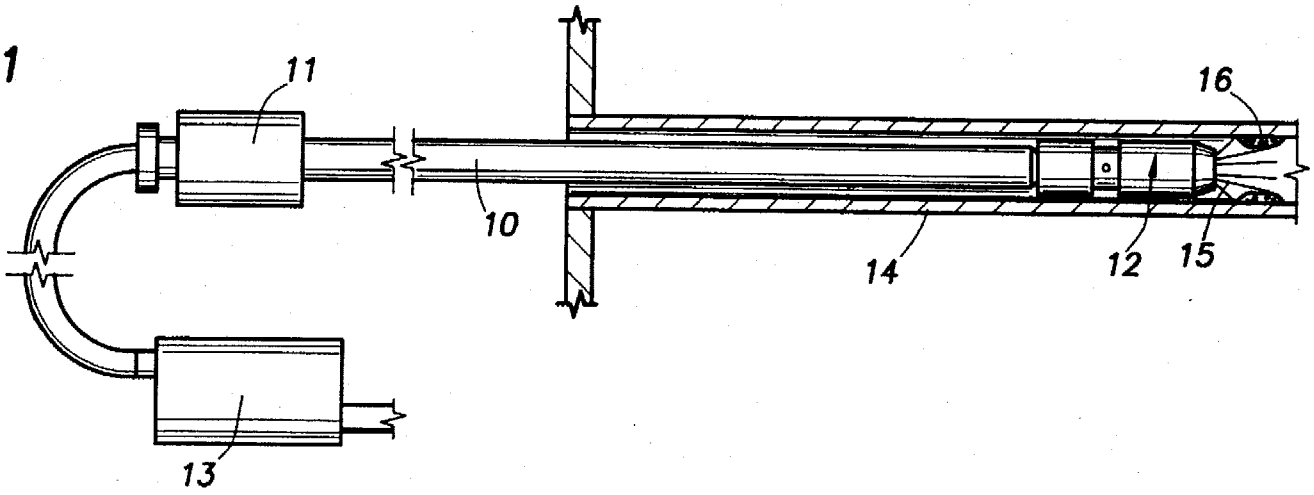
FIG. 1 is a schematic view showing a tube being cleaned by a nozzle assembly on the end of a high pressure lance.

Referring initially to FIG. 1, a long, small diameter pipe or lance 10 has a control valve 11 at its rear end and a cleaning nozzle assembly 12 on its front end. The control valve 11 is connected by a flexible hydraulic hose to a source 13 of high pressure water. The lance 10 and nozzle assembly 12 are pushed by an operator into a tube 14 that is part of a heat exchanger or similar device, so that the spray 15 emanating from the nozzle assembly 12 cuts away and cleans out any material blockage 16 that may have built up inside the tube 14. The nozzle assembly 12 can be operated at very high pressures up into the range of 60,000 psi.

Figure 2:
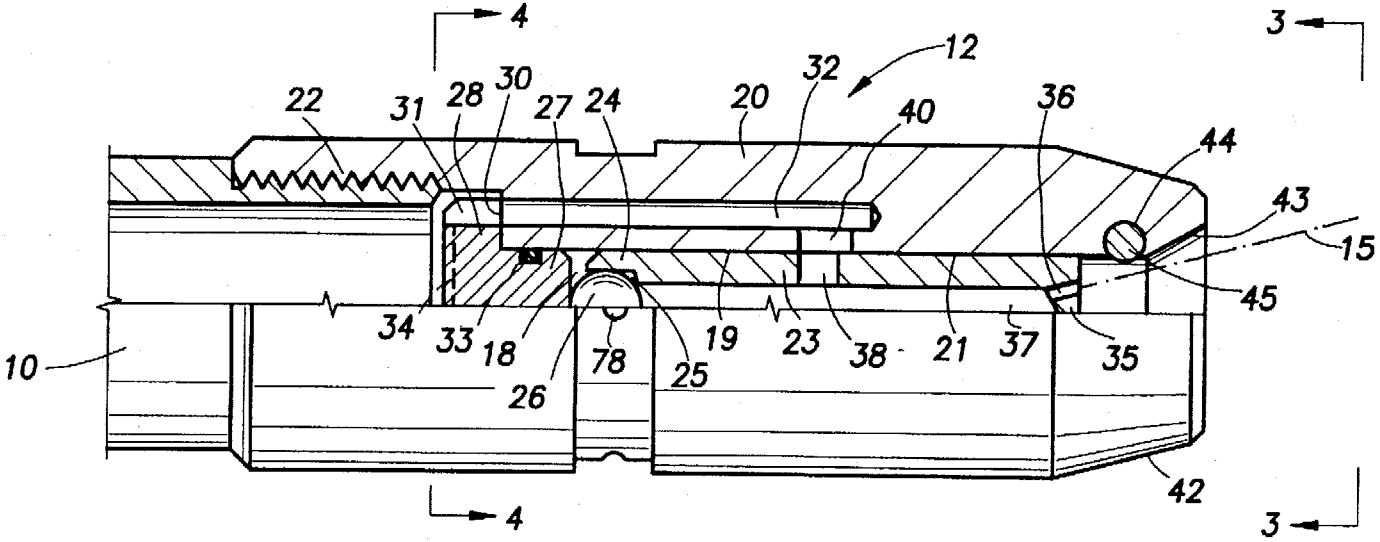
FIG. 2 is a side, quarter-sectional view of a nozzle assembly according to this invention.

As shown in FIG. 2, the nozzle assembly 12 includes a generally tubular body 20 having a stepped-diameter internal bore 21 and a threaded outer portion 22 that is screwed onto the outer end of the lance 10. The outer portion of the bore 21 receives a tubular rotor 23 that is sized to rotate freely therein. The rear portion 24 of the rotor 23 has a counterbore 25 that forms a seat for a ball bearing member 26. The outer part of the bearing member 26 extends beyond the end of the portion 24 and can engage a central point on the outer end surface of a plug 27 which extends a short distance into the bore 21. The bearing member is held in place by crimping the walls which surround the counterbore 25 against it. The plug 27 includes an outwardly directed flange 28 which stops against a shoulder 30. The flange 28 has a plurality of circumferentially spaced, axially extending flow slots 31 (FIG. 4) that line up with a corresponding plurality of axial flow passages 32 in the body 20. A seal ring 33 on the plug 27 prevents fluid leakage into the bore 21 past the plug. A diametral slot shown in dash lines at 34 in the flange 28 can be engaged by the blade of a screwdriver or the like to align the flow slots 31 with the passages 32 during assembly.

The outer end of the rotor 23 has a wall 35 through which a pair of outwardly inclined and skewed nozzle openings 36 (FIG. 3) extend so that flow of water under pressure down the bore 37 and out the nozzle openings creates a reaction torque which causes the rotor 23 to spin within the bore 21 of the body 20. Water enters the bore 37 via radial ports 38 which communicate with the flow passages 32 through an annular groove 40. The front surface 42 of the body 20 can be tapered inwardly as shown, and the inner wall surface 43 tapered outward to provide a flared configuration. A transverse or tangential hole 44 in the front portion of the body 20 receives a pin 45 whose inner margin extends slightly into the bore 21 to limit outward movement of the rotor 23. In the alternative, a retaining ring located at the rear of the body 20 and mounted on the wall of the bore 21 could perform the same functions. In an exemplary arrangement, the cone formed by the diverging sprays from the nozzle openings 36 has an angle of about 15° with respect to the longitudinal axis of the body 20, and thus a total cone angle of about 30°.

An alternative embodiment of the present invention is shown in FIG. 5. Here an adapter 50 is threaded to the outer end of the body 51 at 52, and an o-ring seal 53 prevents fluid leakage past the threads. The adapter 50 has a plug portion 54 at its outer end which extends into the rear portion of the bore 55 in the body 51 and is sealed by an o-ring 56. A plurality of outwardly inclined ports 57 communicate the bore 58 of the adapter 50 with the longitudinal water passages 59 so that high pressure water is fed into the interior of the rotor via an internal annular groove and radial ports as described above. To offset the rearward reaction forces on the assembly 50 as water sprays emanate from the nozzles in the rotor, a plurality of circumferentially spaced ports 61 are formed in the adapter 50 and incline rearward and outward. The reaction force generated by the water sprays emanating from these ports 61 is in the forward direction and offsets or exceeds the rearward reaction forces noted above. This feature makes a cleaning operation much easier for the operator because the nozzle assembly 12 is being forced forward in the tube 14 and against any blockage.

FIG. 6 illustrated another application where the unique nozzle assembly 12 is used in combination with a waterblast gun 70 to clean external surfaces such as those inside a storage tank or the like. The gun 70 is hand held and includes a handle 71, a trigger lever 72 and a guard 73. Water under high pressure comes in through an inlet fitting 74 and passes via a control valve body 75 to an elongate outlet fitting 76 having the nozzle assembly 12 attached to its outer end. The gun 70 can be of the type and structure shown in U.S. Pat. No. 4,602,740 issued to Stachowiak, or in U.S. Pat. No. 5,423,348 issued to Jesek et al. If the assembly 12 touches anything stationary the rotor will continue to spin without interruption because it is protected inside the body 20.

OPERATION

In operation and use, the nozzle assembly 12 is assembled as shown in the drawings and screwed onto the end of the lance 10. The assembly 12 is started into the tube 14 by the operator, who then operates valve 11 to supply high pressure water thereto. As water sprays emanate from the skewed nozzles 36 in the rotor 23, it begins to spin in the bore 21 so that a cone of high velocity cleaning water is directed against the surrounding walls of the tube 14 which cuts away and flushed out any deposits of materials that have built up therein.

Before the rotor 23 starts to spin in the bore 21, a water bearing is created at the rear of the rotor in the following manner. The initial thrust caused by the water sprays or jets issuing from the nozzles 36 causes the rotor 23 to shift rearward in the bore 21 toward the plug 27, which is stationary. Such rearward movement occurs until the ball bearing 26 stops against the front face of the plug 27. Once this occurs, water leaks, or blows by, through the clearance 19 between the outer surfaces of the rotor 23 and the walls of the bore 21 and fills the region 18 adjacent the ball 26. When the region 18 is filled, the rotor 23 is pushed forward when the hydraulic force due to pressure in the region 18 acting on the transverse area of the bore 21 is greater than the rearward thrust on the rotor being generated by the nozzles 36. At this point the rotor 23 is riding on a cushion or bearing of water at its rear and in the clearance 19, and begins to rotate. The water bearing has very low friction so that the rotor 23 spins essentially with no restraint. A rotational speed of about 100,000 rpm can be attained by the rotor 23 during operation at high pressure. Once a flow of high pressure water through the nozzle assembly 12 is initiated, the water bearing is created and the rotor 23 begins to spin in a few seconds thereafter.

The set of small pressure relief holes 78 which communicate with the outside of the body 20, and thus with atmospheric pressure, extend into the rear portion of the body bore 21 and intersect the clearance 19. These holes 78 function in combination with the rotor 23 to regulate the pressure of the water bearing. This pressure relief system is self-regulatory in that the forward motion of the rotor 23, as mentioned above, stops when the back edge of the rotor is just forward of the point where the holes 78 intersect the bore 21. At this point any excess water is bled to the outside via the holes 78. As the water pressure inside the rotor 23 is increased, the thrust load toward the rear is increased. The pressure in the water bearing region 18 is increased proportionately, so that the water beating and rotor pressures are maintained substantially the same. These pressures thus are self-regulating with nozzle supply pressures ranging from about 100 psi to about 60,000 psi.

When the front nose of the body 20 encounters a stationary object or a blockage of material inside of the tube 14, the rotor 23 is not stopped or even slowed down, but continues to rotate freely because its front wall 35 is well behind the front surfaces of the nose. Thus the nozzle assembly 12 does not have to be backed up by the operator to enable rotation to restart, as in certain prior devices. Moreover there is assurance of continuous rotation on account of the construction of the present invention, where in such prior devices it could not be ascertained whether the rotor was spinning or not.

In the embodiment shown in FIG. 5, the reaction force due to the rearwardly inclined ports 61 at least offsets the rearward reaction force generated by the nozzles 36 in use, so that much less effort is needed to advance the nozzle assembly 12 into the tube 14.

It now will be recognized that a new and improved forward cleaning and spinning nozzle assembly has been disclosed which continues to clean in engagement with blocking material in a tube or in the event the assembly contacts a stationary object when cleaning an external or internal surface. This is because the rotor is protected and does not engage such material or object. Since certain changes or modification may be made in the disclosed embodiment without departing from the inventive concepts involved, it is the aim of the appended claims to cover all such changes and modifications that fall within the true spirit and scope of the present invention.

What is claimed is:

1. A nozzle assembly for use in cleaning materials from a surface, comprising: an outer tubular body having a bore and adapted to be connected to a source of cleaning liquid under pressure; rotor means mounted within said bore of said body for limited axial movement and having front and rear walls and an axial flow passage; nozzle means extending through said front wall and arranged to create reaction forces in response to liquid flow which causes said rotor means to spin; passage means for communicating said axial flow passage with said liquid under pressure; and means forming a liquid bearing adjacent said rear wall of said rotor means during spinning of said rotor means for urging said rotor means forwardly.

2. The assembly of claim 1 further including means plugging the bore of said body to the rear of said rotor means, said liquid bearing being located in the region between said plugging means and said rear wall of said rotor means.

3. The assembly of claim 2 further including means for feeding liquid under pressure from said passage means to said region to create a forward thrust force on said rotor means that opposes the rearward thrust force thereon in response to flow of liquid through said nozzle means.

4. The assembly of claim 3 further including automatically operable regulator means for regulating the pressure of liquids in said region.

5. The assembly of claim 4 wherein said regulator means includes at least one flow port communicating with the exterior of said body with said bore adjacent said region.

6. The assembly of claim 1 wherein said rear wall of said rotor means includes mechanical bearing means.

7. The assembly of claim 6 wherein said mechanical bearing means includes annular recess means in said rotor means, a ball bearing seated in said recess means, and means for retaining said ball bearing means in said recess means.

8. The assembly of claim 1 further including secondary nozzle means in said body, said secondary nozzle means being inclined outward and rearward produce a forward thrust force on said body which assists in moving said nozzle assembly forward.

9. A nozzle assembly for use in cleaning materials from a surface, comprising: a generally tubular body having an axial bore and means on the rear end portion thereof for connecting said body to a tubular member through which liquid under pressure is supplied to said body, said body having an open front end; cylindrical rotor means mounted within said bore for limited axial movement therein, said rotor means having an axial passageway and front and rear walls; outwardly inclined and axially skewed nozzles in said front wall forming high velocity liquid sprays that create reaction forces which cause said rotor to spin in said bore and produce an outwardly diverging, conical spray pattern that dislodges material from the said surface; stop means engaging said front wall of said rotor means to maintain said wall rearward of said front end of said body; radial passage means in said rotor means; longitudinal passage means in said body outside said bore for communicating liquid under pressure to said radial passage means and to said axial passageway during spinning of said rotor means in said bore; means plugging said bore of said body rearward of said rotor means and providing an interior region between said plugging means and said rear wall of said rotor means; and clearance means between the exterior of rotor means and the surrounding surfaces of said bore through which liquid under pressure can flow into said region and provide a liquid bearing therein, the pressure of said liquid applying forwardly directed force to said rotor means.

10. The assembly of claim 9 further including port means in said body for communicating the exterior thereof with said clearance adjacent the front of said region to cause regulation of the pressure of said liquid bearing by enabling selective bleed-off of said pressure at a forward position of said rotor means in said bore.

11. The assembly of claim 9 further including retainer means on said body for limiting forward movement of said rotor means.

12. The assembly of claim 9 further including mechanical bearing means providing said rear wall of said rotor means and engageable with said plugging means to limit rearward movement of said rotor means.

13. The assembly of claim 12 where said mechanical bearing means includes an element providing point contact with said plugging means.

14. The assembly of claim 9 further including secondary nozzle means in said body that are inclined outward and rearward thereof to generate forward thrust forces to assist in moving said nozzle assembly forward.

15. A nozzle assembly adapted to spin in a surrounding body and produce a generally conical spray pattern, comprising: an outer tubular member forming said surrounding body; an inner tubular member mounted entirely within said surrounding body and having a front wall, a central bore, and radial port means for admitting water under pressure into said bore; at least one nozzle opening extending through said front wall and arranged in a manner such that water passing therethrough produces a reaction torque that causes said tubular member to spin in said body, said member having a rear portion; annular seat means in said rear portion; and spherical seal means engaging said seat means, said rear portion including means for retaining said seal means on said seat means.

16. The assembly of claim 15 wherein said seat means is formed by a counterbore extending into said rear portion and defining an annular edge engaging said seal means and an annular wall that surrounds said seal means, said retaining means including a portion of said annular wall that is crimped inward against said seal means.

17. The assembly of claim 16 wherein said spherical seal means has a rear portion that extends outward of said retaining means to provide a bearing against an adjacent wall.

18. A nozzle assembly for use in cleaning materials from a surface, comprising: a tubular body having a bore and adapted to be connected to a source of cleaning liquid under pressure; rotor means mounted within said bore and having front and rear walls and an axial flow passage; nozzle means extending through said front wall and arranged to create reaction forces in response to liquid flow which causes said rotor means to spin; passage means for communicating said axial flow passage with said liquid under pressure; and means forming a liquid bearing adjacent said rear wall of said rotor means during spinning of said rotor means; said body having a front end surface, said front wall of said rotor means being located rearward of said front end surface so that said surface prevents engagement of said front wall with material being cleaned from the surface.

* * * * *